US005720406A

United States Patent [19]

Fassbind et al.

[11] Patent Number: 5,720,406

[45] Date of Patent: Feb. 24, 1998

[54] REACTION CONTAINER ARRANGEMENT FOR USE IN A THERMAL CYCLER

[75] Inventors: Walter Fassbind, Baar; Emanuele Japichino, Sins, both of Switzerland

[73] Assignee: Roche Diagnostic Systems, Inc., Branchburg, N.J.

[21] Appl. No.: 698,659

[22] Filed: Aug. 16, 1996

Related U.S. Application Data

[63] Continuation of Ser. No. 301,955, Sep. 7, 1994, abandoned.

[30] Foreign Application Priority Data

Sep. 10, 1993 [CH] Switzerland ..... 2718/93

[51] Int. Cl.[6] ..... B65D 21/02

[52] U.S. Cl. ..... 220/23.4; 220/23.83; 220/604; 220/669

[58] Field of Search ..... 220/23.2, 23.4, 220/23.83, 23.86, 604, 669

[56] References Cited

U.S. PATENT DOCUMENTS

| | | |
|---|---|---|
| 3,713,771 | 1/1973 | Taylor et al. . |
| 4,338,279 | 7/1982 | Orimo et al. . |
| 4,865,986 | 9/1989 | Coy et al. . |
| 4,933,146 | 6/1990 | Meyer et al. . |
| 5,050,007 | 9/1991 | Akanabe et al. . |
| 5,123,477 | 6/1992 | Tyler . |
| 5,145,646 | 9/1992 | Tyranski . |
| 5,156,809 | 10/1992 | Hupe et al. . |
| 5,171,531 | 12/1992 | Christianson et al. . |
| 5,176,203 | 1/1993 | Larzul . |
| 5,187,084 | 2/1993 | Hallsby . |
| 5,207,987 | 5/1993 | Kureshy et al. . |
| 5,446,263 | 8/1995 | Eigen et al. . |
| 5,455,175 | 10/1995 | Wittwer et al. . |
| 5,604,101 | 2/1997 | Hanley et al. . |
| 5,616,301 | 4/1997 | Moser et al. . |

FOREIGN PATENT DOCUMENTS

| | | |
|---|---|---|
| 15624/88 | 11/1988 | Australia . |
| 100 663 | 2/1984 | European Pat. Off. . |
| 236 069 | 2/1987 | European Pat. Off. . |
| 369 840 | 5/1990 | European Pat. Off. . |
| 415 307 | 3/1991 | European Pat. Off. . |
| 488 769 | 11/1991 | European Pat. Off. . |
| 542 319 | 5/1993 | European Pat. Off. . |
| 171 140 | 8/1993 | European Pat. Off. . |
| 3 024 210 | 1/1982 | Germany . |
| 8 804 938 | 5/1988 | Germany . |
| 61-212764 | 9/1986 | Japan . |

(List continued on next page.)

OTHER PUBLICATIONS

Wyld, Radio and Electronic Engineer, "An Automatic Biochemical Analyser", vol. 42, No.9, pp. 391–401 (Sep. 1972).

Derwent Abstract No. 90–017341.

L. Haff et al., BioTechniques, vol. 10, No. 1, p. 102 ff. (9 pages)(1990).

*Primary Examiner*—Joseph M. Moy

*Attorney, Agent, or Firm*—George W. Johnston; William H. Epstein; John P. Parise

[57] ABSTRACT

A throwaway arrangement of reaction containers each having the same shape and dimensions for bringing about temperature cycles in a liquid mixture contained within the reaction containers. Each reaction container having a first conical wall region, and a second cylindrical wall region which at one end forms the opening of the reaction container. The thickness of the first wall region is less than the thickness of the second wall region. The opening of the reaction container is adapted to receive a cover for closing the container in gas-tight manner when placed on the opening of the reaction container. To facilitate handling and access to the liquids in the reaction containers, the arrangement reaction containers is annular, and the closure of each reaction container can be pierced by a pipetting needle.

14 Claims, 13 Drawing Sheets

FOREIGN PATENT DOCUMENTS

| | | |
|---|---|---|
| 64-500295 | 2/1989 | Japan . |
| Y2-20170 | 2/1990 | Japan . |
| Y2-17341 | 5/1990 | Japan . |
| 5-188059 | 7/1993 | Japan . |
| 89/12829 | 12/1989 | WIPO . |
| 91/18551 | 12/1991 | WIPO . |
| 92/04978 | 4/1992 | WIPO . |
| 92/20778 | 11/1992 | WIPO . |

87
25
23
21
85
24

2
47
29;48
19
VIII
18
22
28
29
28
28
46
29
54
27
26
33
84
VIII
34
45
45

62
23
25
85
24
21
31
29
2
28
56
57
61
58
53
61
59
55
54
26
56
27
84
34
18

REACTION CONTAINER ARRANGEMENT FOR USE IN A THERMAL CYCLER

This is a continuation of application Ser. No. 08/301,955, filed Sep. 7, 1994; now abandoned.

BACKGROUND OF THE INVENTION

1. Field

The invention relates to a disposable arrangement of reaction containers each having the same shape and dimensions for bringing about temperature cycles in a liquid mixture contained within the reaction containers. Each reaction container has a first conical wall region and a second cylindrical wall region which at one end forms the opening of the reaction container. The thickness of the first wall region is less than the thickness of the second wall region. The opening of the reaction container is adapted to receive a closure for closing the container in gas-tight manner. More particularly, the invention relates to an arrangement of reaction containers for use in a "thermal cycler" suitable for cycling temperates during a polymerase chain reaction. A thermal cycler is a device for automatic performance of temperature cycles.

2. Description

Reaction containers of the aforementioned kind are described in EP-A0 236 069. In this known device, reaction containers are disposed in a matrix, which makes it difficult to obtain a uniform temperature in all of the reaction containers. In addition, handling of the reaction containers is relatively complicated because the containers have to be individually opened by hand after completion of the polymerase chain reaction to remove the reaction products.

Consequently, the reaction containers described in EP-A-0 236 069 A2 are unsuitable for use in a modern automatic analytical device, in which the handling of the reaction container and the associated pipetting of liquids from the reaction containers should be fully automated.

An aim of the invention therefore is to provide an arrangement of reaction containers which achieve the aforementioned aims.

According to the invention, this problem is solved by an annular (arcuate) arrangement of reaction containers in which the closure of each reaction container can be pierced by a pipetting needle.

Advantages of the inventive reaction container arrangement are (i) very uniform temperature distribution in the entire arrangement of reaction containers (at any time the temperature in all containers is the same), and (ii) the contents of the containers can be pipetted in completely automatic manner (the arrangement is suitable for use in a modern automatic analytical device).

SUMMARY OF THE INVENTION

An arrangement of reaction containers is provided. Each reaction chamber has substantially the same shape and dimensions for bringing about temperature cycles in a liquid mixture contained within the reaction-containers. The arrangement comprises a plurality of reaction containers and a plurality of closures. Each reaction container has a first conical wall region, and a second cylindrical wall region adjacent the first conical wall region, and is open at one end to form the opening of the reaction container. The thickness of the first wall region is less than the thickness of the second wall region. Each closure is configured and dimensioned to fit within the opening of a reaction container and close the reaction container in gas-tight manner. Each closure is piercable by a pipetting needle. For convenience, a plurality of joined reaction chambers may be referred to as an assembly of reaction chambers. Likewise, a plurality of joined closures may be referred to as an assembly of closures.

Preferably, reaction containers are made in one piece from a plastic, and adjacent reaction containers are joined by a flexible web to form an assembly of reaction containers. Closures are typically made in one piece from the same plastic as the plurality of reaction containers, with adjacent closures in the arrangement being joined by at least one flexible web to form an assembly of closures. More preferred is where reaction containers and closures are arranged as a continuous loop. The term "continuous loop" includes, but is not limited to, circular, oval and polygonal configurations, with circular being most preferred.

Alternatively, the arrangement of the plurality of plastic reaction containers may form at least a segment of a ring, with adjacent reaction containers being joined by a flexible web. In such a configuration, it is preferred that the arrangement can be assembled by means of an arrangement of closures which like the arrangement of reaction containers forms at least a segment of a ring, and is made in one piece from the same plastic as the reaction containers, with adjacent closures in the arrangement being joined by at least one flexible web. Each closure is adapted to close one reaction container in gas-tight manner when placed in the opening thereof. As above, the arrangements of the plurality of reaction containers or the plurality of closures may form a complete ring.

A more preferred arrangement of reaction containers includes a plurality of reaction chambers made in one piece from a plastic. Each reaction container is joined to at least one other reaction container by a flexible web, and is formed from a first conical wall region, and a second cylindrical wall region as described above. A plurality of closures, made in one piece from the same plastic as the reaction containers described above, each have substantially the same shape and dimensions for bringing about temperature cycles in a liquid mixture contained within the reaction containers.

In all embodiments, it is preferred that the arrangement has an extension for use as a reference member for positioning or detecting the arrangement.

BRIEF DESCRIPTION OF THE FIGURES

An embodiment of the invention will now be described with reference to the accompanying drawings, in which.

DETAILED DESCRIPTION OF THE INVENTION

The subject invention will now be described in terms of its preferred embodiments. These embodiments are set forth to aid in understanding the invention, but are not to be construed as limiting.

Figure 1:
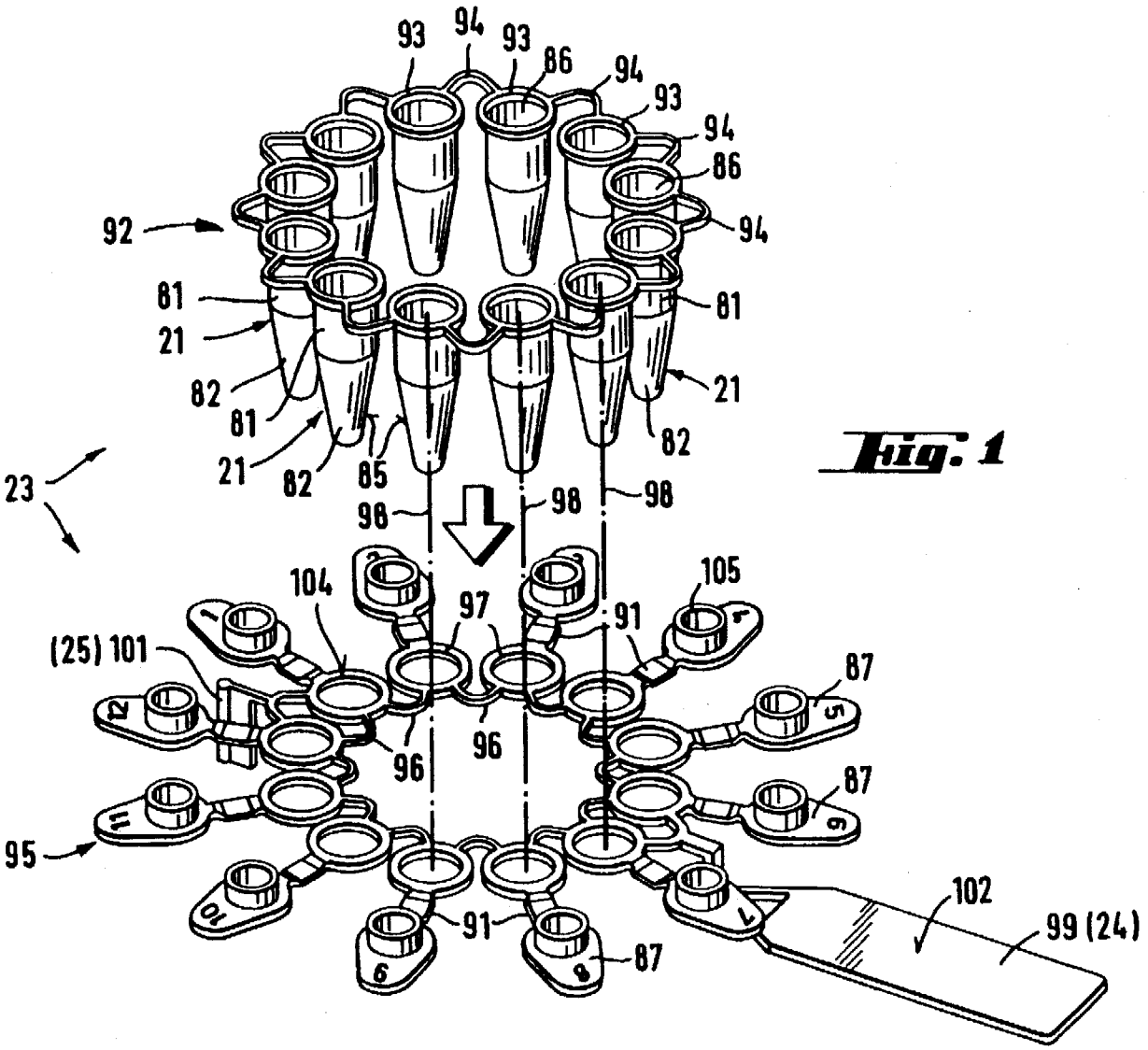
FIG. 1 is a perspective exploded view of the individual parts 92 to 95 of a first embodiment of a reaction container arrangement 23 according to the invention, for insertion in a thermal cycler.
Figure 2:
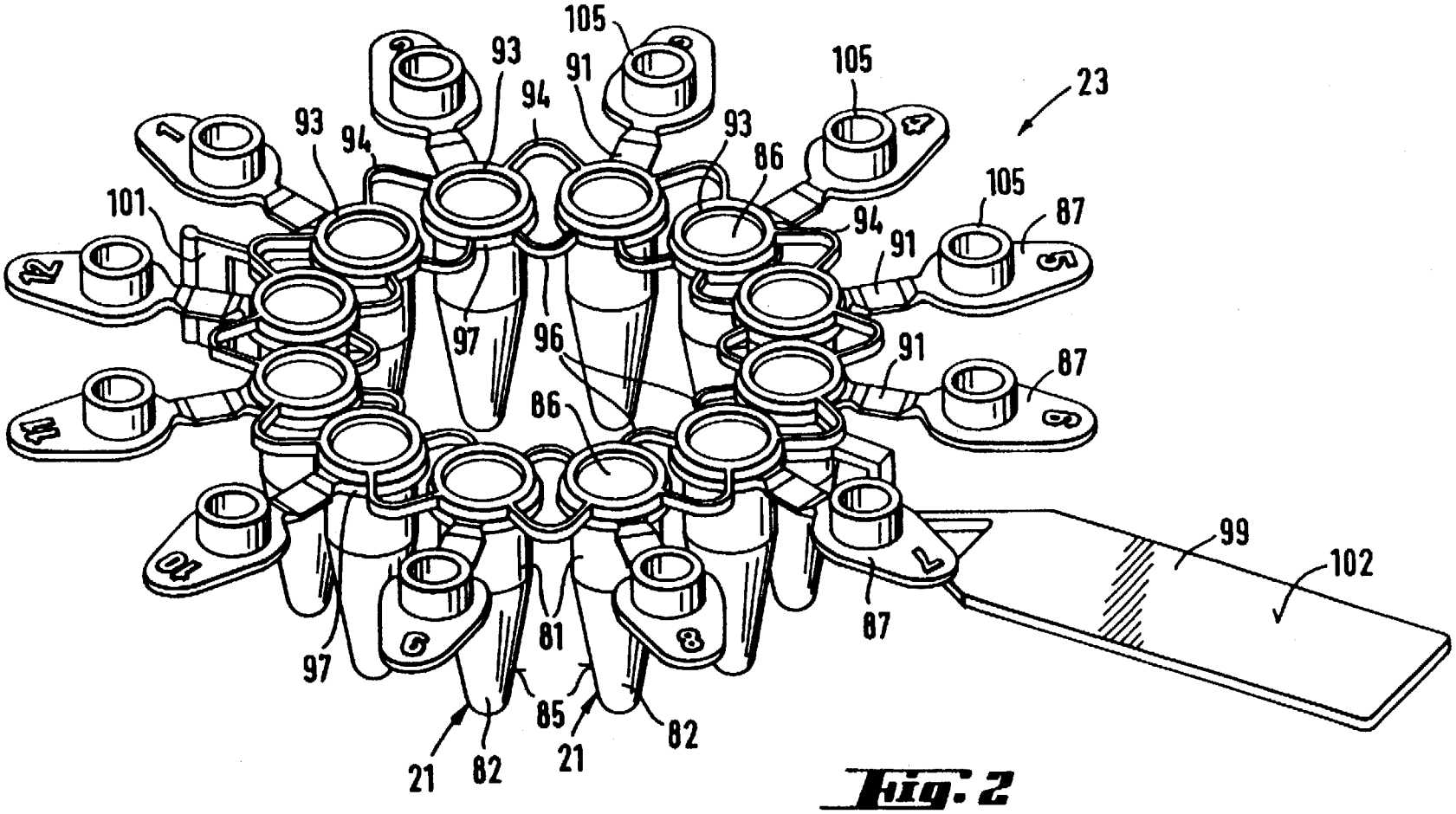
FIG. 2 shows the individual parts 92–95 in FIG. 1, assembled, and with the containers in the thus-formed arrangement 23 in the open state.
Figure 3:
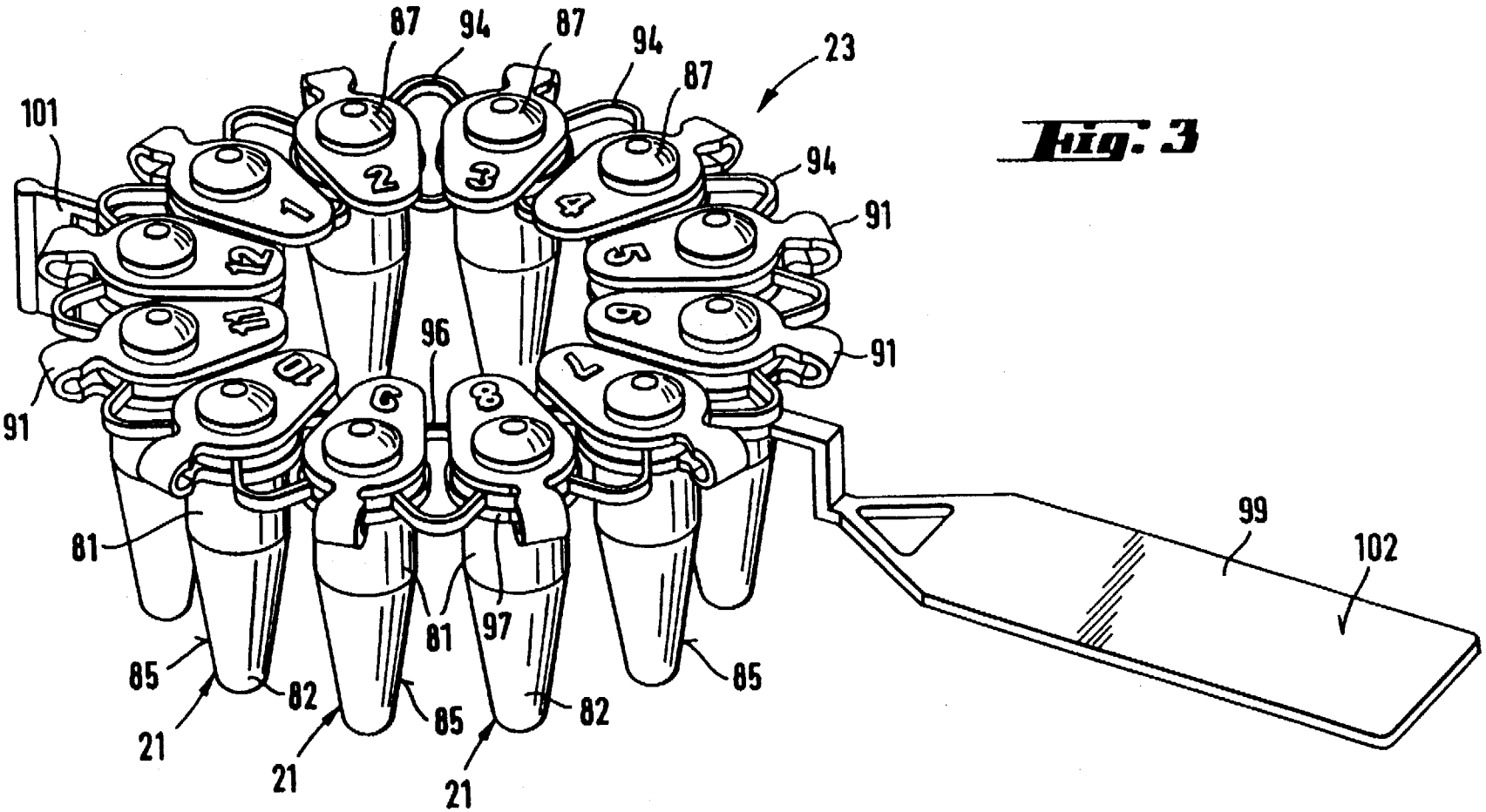
FIG. 3 shows the individual pans 92–95 in FIG. 1 assembled, and with the containers in the resulting arrangement 23 in the closed state.
Figure 4:
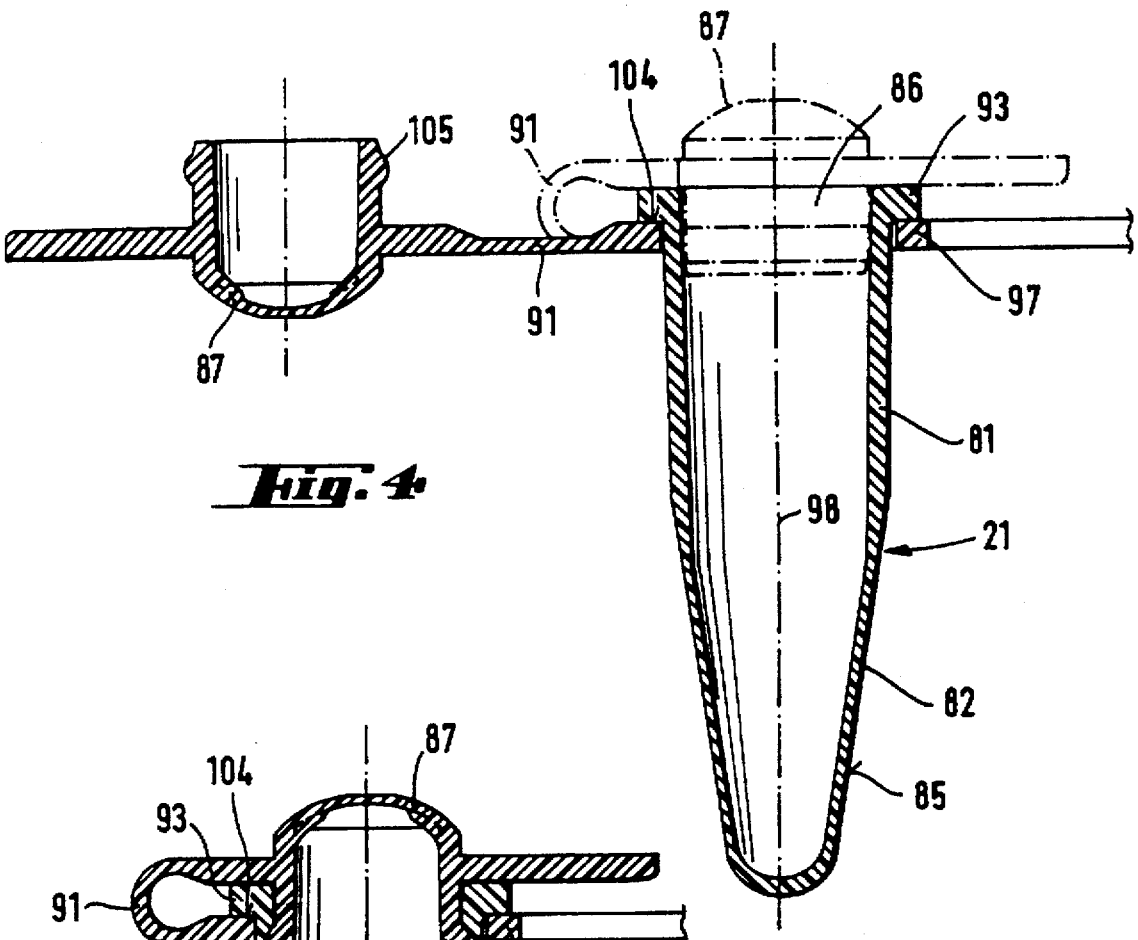
FIG. 4 is a section through a reaction container 21 in FIG. 2, with an open lid 87.
Figure 5:
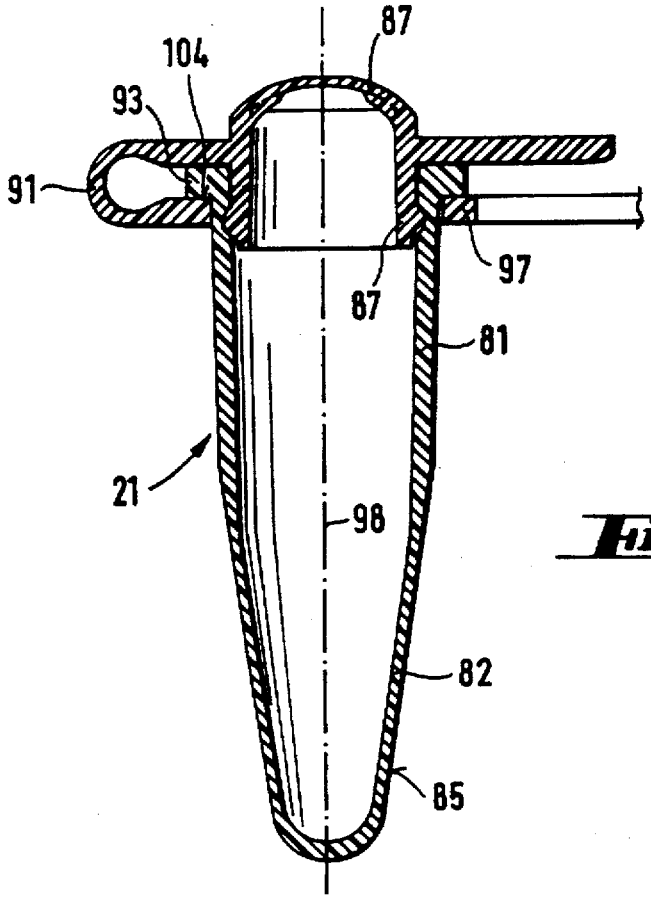
FIG. 5 is a section through a reaction container 21 in FIG. 2, with a closed lid 87.

First embodiment of an arrangement of reaction containers according to the invention FIGS. 1–3 show a first embodiment of a reaction container arrangement 23 according to the invention, for insertion in a thermal cycler. FIGS. 4 and 5 show cross-sections of one of the reaction containers 21 in the arrangement 23.

As shown in FIGS. 1 to 5, the reaction containers 21 have a conical lower region 82 and a cylindrical upper region 81. To improve heat transfer, the conical lower region 82 of the container 21 containing the sample for heat-treatment is provided with thinner walls than the upper cylindrical region 81. As shown, particularly in FIG. 8, the lower conical region 82 of the container 21 fits exactly into a correspondingly-shaped recess 27 in the unit heater 33 of the thermal cycler 18, so that the conical inner wall of the recess 27 in the unit heater 33 is in full contact with the conical outer wall 85 of the lower region 82 of the reaction container 21, thus ensuring optimum heat transfer.

The reaction container 21 has an opening 86 which can be sealed by a lid 87. The lid 87 can be pierced by a pipetting needle 32 for removing a sample of material.

To reduce expense and facilitate handling of the reaction containers 21, a number of containers, for example twelve, are combined in a unit, preferably in a continuous circular configuration to form a ring of reaction containers, with the lid 87 being non-detachably secured by a film joint 91.

Advantageously, the arrangement 23 of reaction containers has two parts. One part 92 consists of reaction containers 21 spaced apart at equal angles and connected in a circle by thin webs 94 at flange-like larger-diameter portions 93 at the opening end. The webs 94 are V-shaped so that the rings 92 are flexible, which is advantageous when combining with the other part 95. Part 92 is preferably made of polypropylene (PP).

The other part 95 of the arrangement 23 comprises rings 97 disposed in a circle and connected by webs 96. The inner diameter of the rings are identical with the outer diameter of the cylindrical regions 81 of the reaction containers 21. The centers of the rings are in line with the longitudinal axes 98 of the reaction containers 21. The webs 96 are V-shaped to obtain radial elasticity. Radially outwardly extending film joints 91 are integrally formed on the rings 97 and each end in a lid 87. Part 95 is preferably also made of polypropylene (PP).

Two radially outwardly projecting, diametrically opposite extensions 99 and 101 are integrally formed on the other part 95, and are offset by half the spacing angle between the rings 97. One extension 99 has a horizontal surface 102, on which, for example, the data on the samples in the reaction containers 21 may be recorded via a bar code. The other extension 101, in the form of a vertical lug, cooperates with a detector 26, for example as a light barrier, in the thermal cycler 18 (see FIG. 7). By this means, the reaction container arrangement 23 is automatically inserted in a defined manner into the thermal cycler 2.

To give a clearer view to the operator, the sample number can be shown on the lid flaps of the sample tubes.

When the two parts 92, 95 of the arrangement 23 are fitted together (FIG. 2), the flanges 93 of the containers 21 in the first part 92 abut the top surface 104 of the rings 97 in the other part 95. As a result of the narrow fit between the cylindrical region 81 and the ring 97, the reaction-container arrangement 23 is preassembled in relatively rigid manner and can be filled with the appropriate samples. The lid 87 is then folded over and its cylindrical extension 105 is held in sealing-tight manner in the opening 86 in the reaction containers 21 (FIG. 3).

The webs 94, 96 provided in the aforementioned structure 23 give it flexibility, so that the reaction containers 21 can very easily be inserted into the recesses 27 of the unit heater 33, which can be difficult in a rigid arrangement 23, even if there are only slight deviations from the dimensions of the unit heater or the arrangement 23.

The two-part arrangement 23 can save a considerable amount of material, and advantageously, can use materials (plastics) having different properties, an important consideration in the case of throwaway articles (the reaction-container arrangement is typically thrown away after use).

Figure 6:
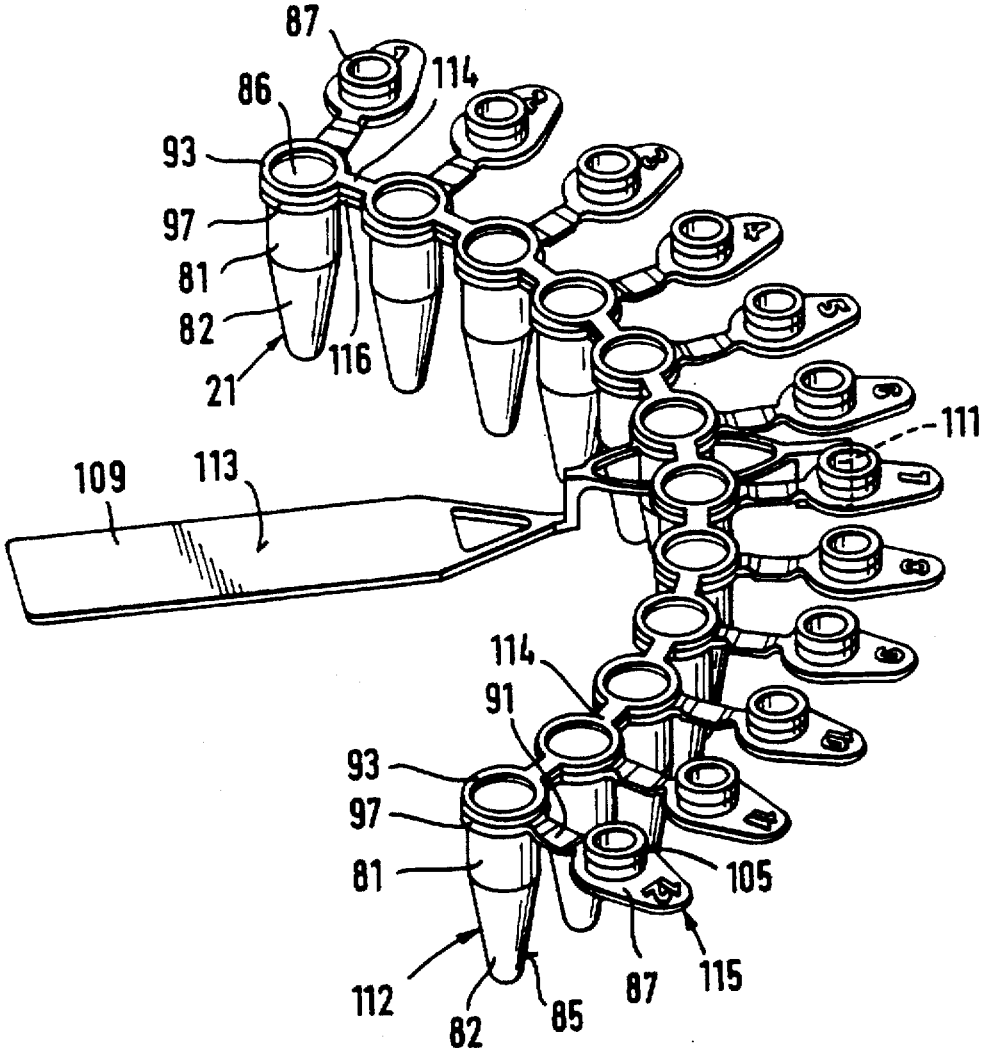
FIG. 6 is a perspective view of a second embodiment of an arrangement of reaction containers according to the invention.

Second embodiment of an arrangement of the reaction containers according to the invention FIG. 6 is a perspective view of a second embodiment of an arrangement 103 of reaction containers according to the invention. This arrangement is made up of a first annular segment 112 comprising an arrangement of reaction vessels 21, and a second annular segment 115 comprising an arrangement of closure lids 87.

The arrangement of reaction containers 21 in the annular segment 112 has substantially the same structure as the arrangement 92 in FIG. 1, the only difference being that the arrangement of reaction containers 21 does not form a complete ring. The arrangement of closure lids 87 in the annular segment 115 has substantially the same structure as the arrangement 95 in FIG. 1, the only difference being that the arrangement of reaction containers 21 does not form a complete ring.

Two radially outwardly projecting, diametrically opposite extensions 109 and 111 are integrally formed on part 115 and are offset by half the spacing angle between the rings 97. One extension 109 has a horizontal surface 113 on which the data on the samples in the reaction containers 21 can be recorded, e.g. in a bar code. The other extension 111, in the form of a vertical lug, cooperates with a detector 26, e.g. a light barrier, in the thermal cycler 18 (see FIG. 7). By means of this device, the arrangement 103 of reaction containers is automatically inserted into the thermal cycler 18 in a defined position.

Thermal cycler

The following description is of a thermal cycler for the automatic performance of temperature cycles in at least one reaction container 21 closed by a closure and containing a predetermined volume of a liquid reaction mixture.

The following is a description of a thermal cycler according to the invention, preferably suitable as a component of an automatic analytical device for bringing about the polymerase chain reaction. The analytical device is designed, for example, for performance of immunoassays.

Figure 7:
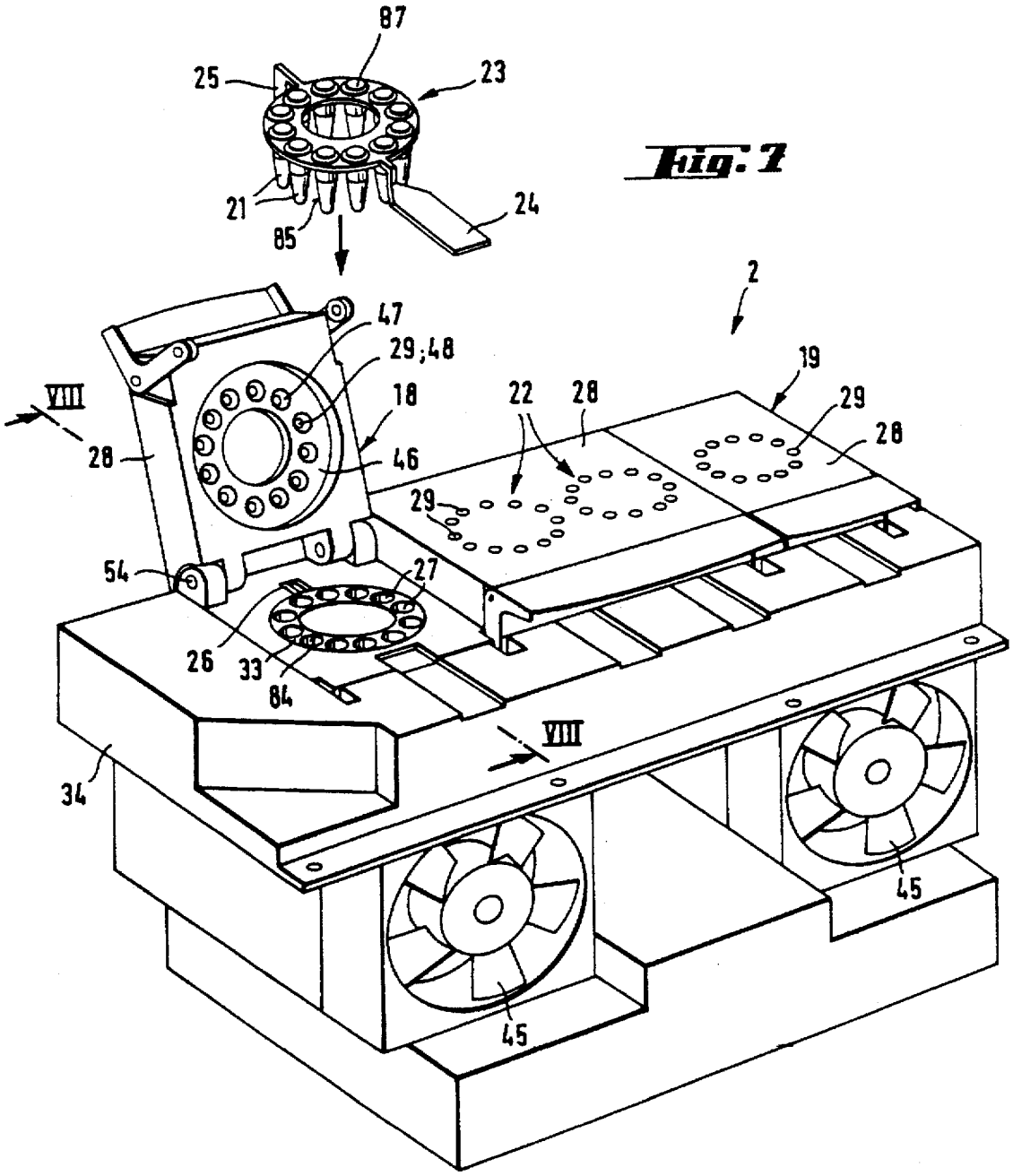
FIG. 7 shows a thermal cycler part 2 removed from an analytical device and comprising thermal cyclers 18 and 19, the thermal cycler 18 being open and a reaction container ring 23 removed therefrom being shown.
Figure 14:
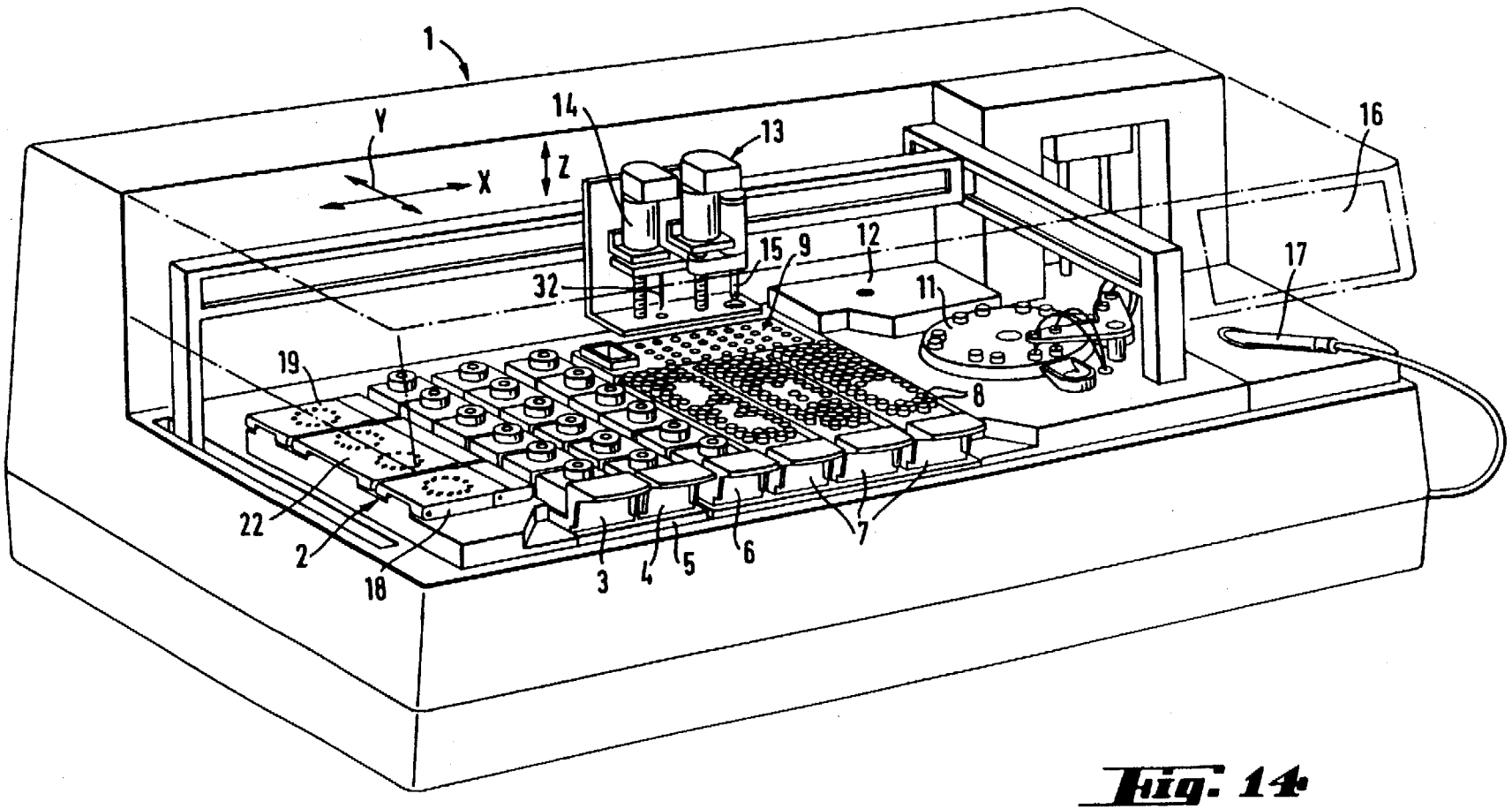
FIG. 14 is an overall perspective view of an analytical device containing a thermal cycler part 2.

FIG. 7 shows a thermal cycler part 2, removed from an analytical device 1 as per FIG. 14. The thermal cycler part 2 contains (for example, two) identical thermal cyclers 18, 19 and a standby station 22. The following description of the thermal cycler 18 also applies to the thermal cycler 19.

Figure 12:
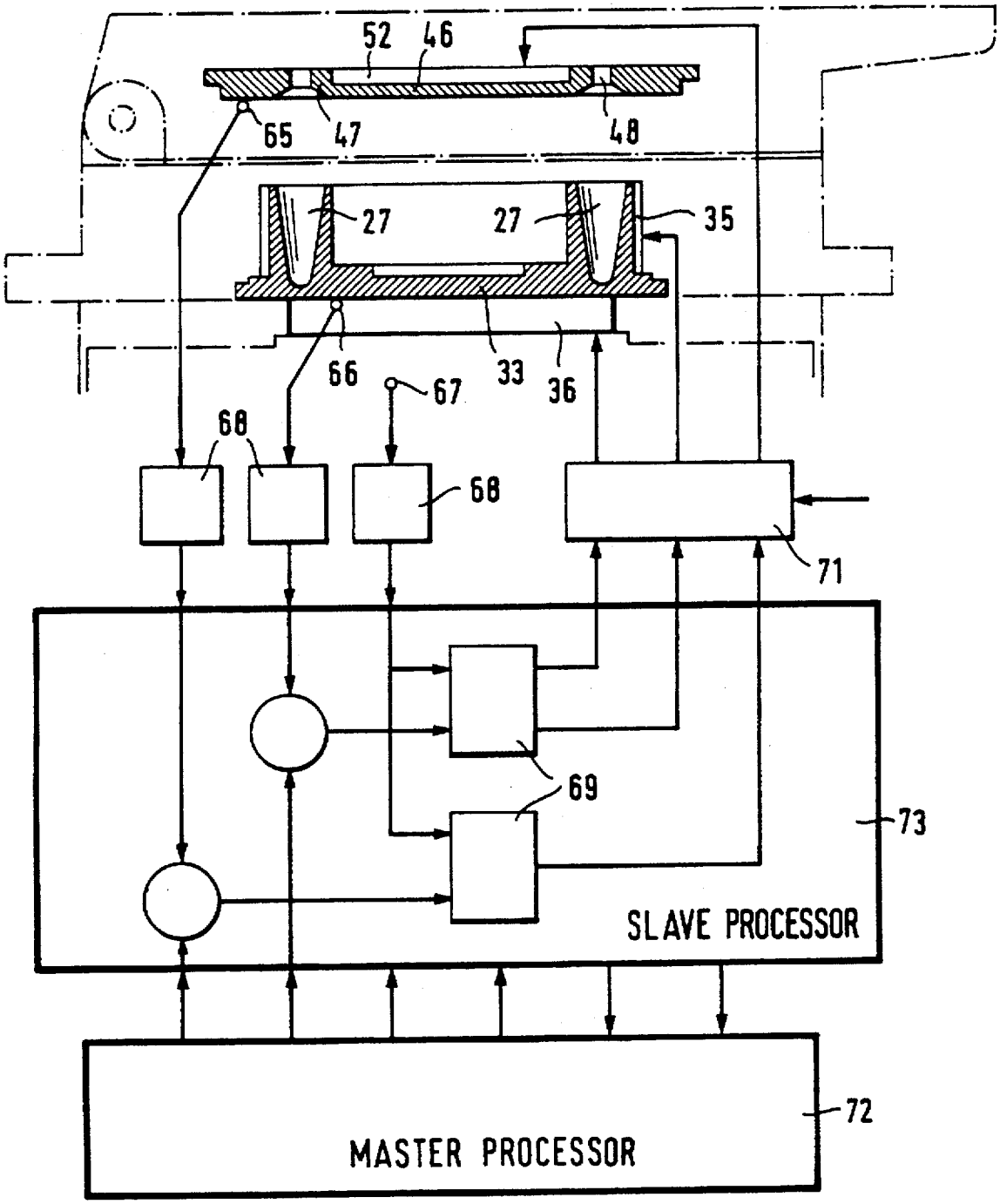
FIG. 12 is a diagram of a "master-slave" control system for adjusting and monitoring the operating parameters of a thermal cycler.

The thermal cycler 18 contains the following components:

(a) a unit heater 33, which holds the reaction containers and has an annular arrangement of recesses 27, each recess serving as a chamber for holding the lower part of one of the reaction containers 21, (b) a computer-controlled automatic control system shown in FIG. 12, and (c) heating or cooling elements controlled by the automatic control system for cyclic alteration of the temperature of the unit heater 33.

The unit heater 33 preferably has an aluminum, silver or other thermally conductive body.

Figure 9:
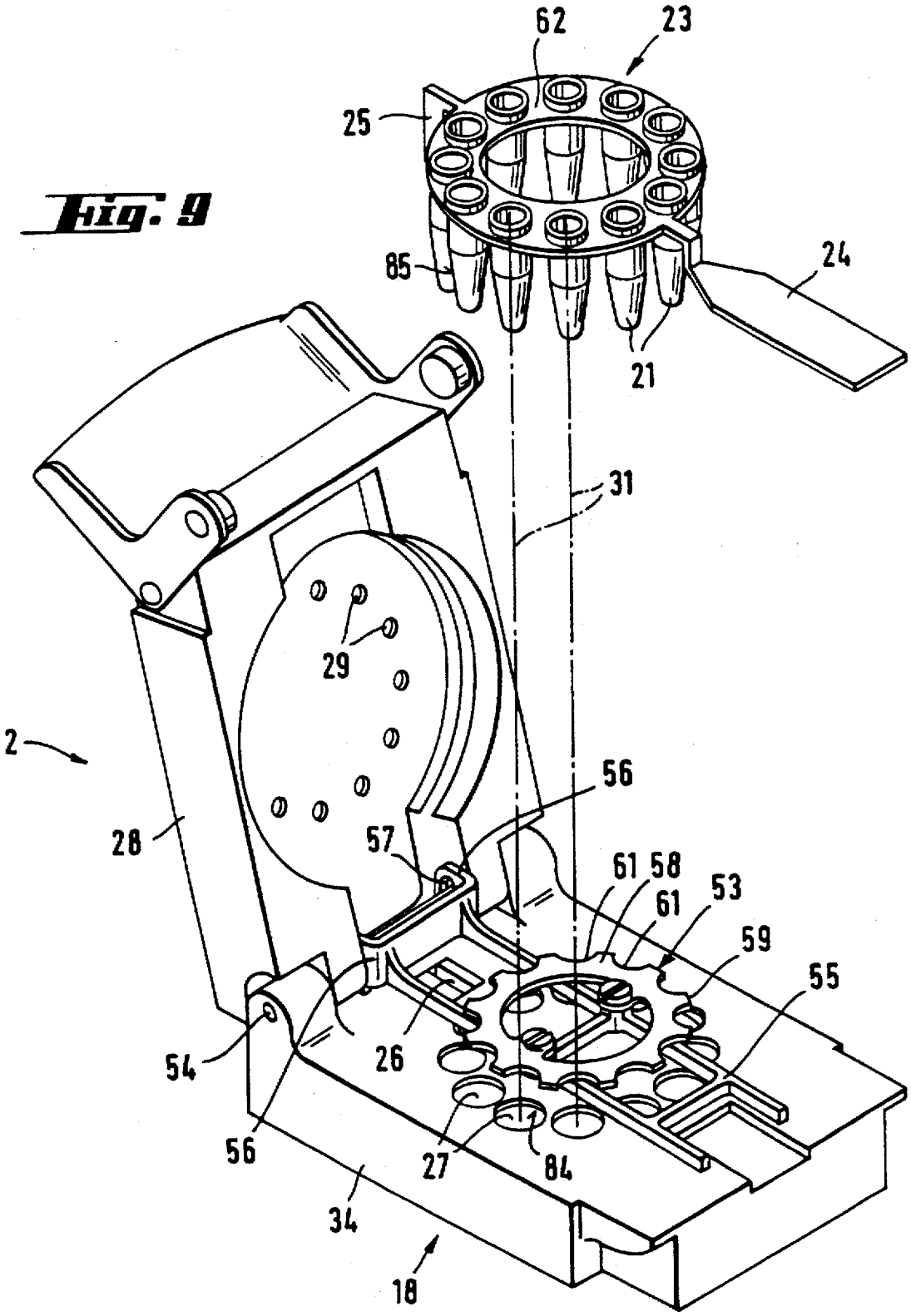
FIG. 9 is a perspective view of the thermal cycler 18 in FIG. 9, supplemented by a lifting-out device 53.

As shown in FIGS. 7 and 9, twelve reaction containers 21 (for example) are combined in a ring 23.

The containers 21 are conical in the lower region, cylindrical in the upper region, and sealed by a lid 87. As clearly shown in FIGS. 7 and 9, an arrangement 23 can be inserted into corresponding recesses 27 in the unit heater 33 of the thermal cycler 18.

Means for Recognizing a Marking on the Reaction-Container Ring

The thermal cycler 18 preferably contains means for recognizing a marking on the reaction-container arrangement 23 (for example, marking in the form of a vertical lug 25). The lug 25 cooperates with a detection device 26 inside the thermal cycler 18, to detect the presence of the ring 23 in the thermal cycler 18. The detection device 26 is, for example, a light barrier (or detector). The lug 25 also enables the arrangement 23 to be positioned only once in the unit heater 33. The single positioning, in combination with numbering of the closures of the reaction containers, can be used for a one-to-one sample-patient correlation.

The arrangement 23 also comprises a flap 24. Flap 24 may have, for example, a surface for carrying data on the contents of the samples in the arrangement 23, the data being present, for example, in the form of a bar code.

Access to the Contents of a Reaction Container

Figure 8:
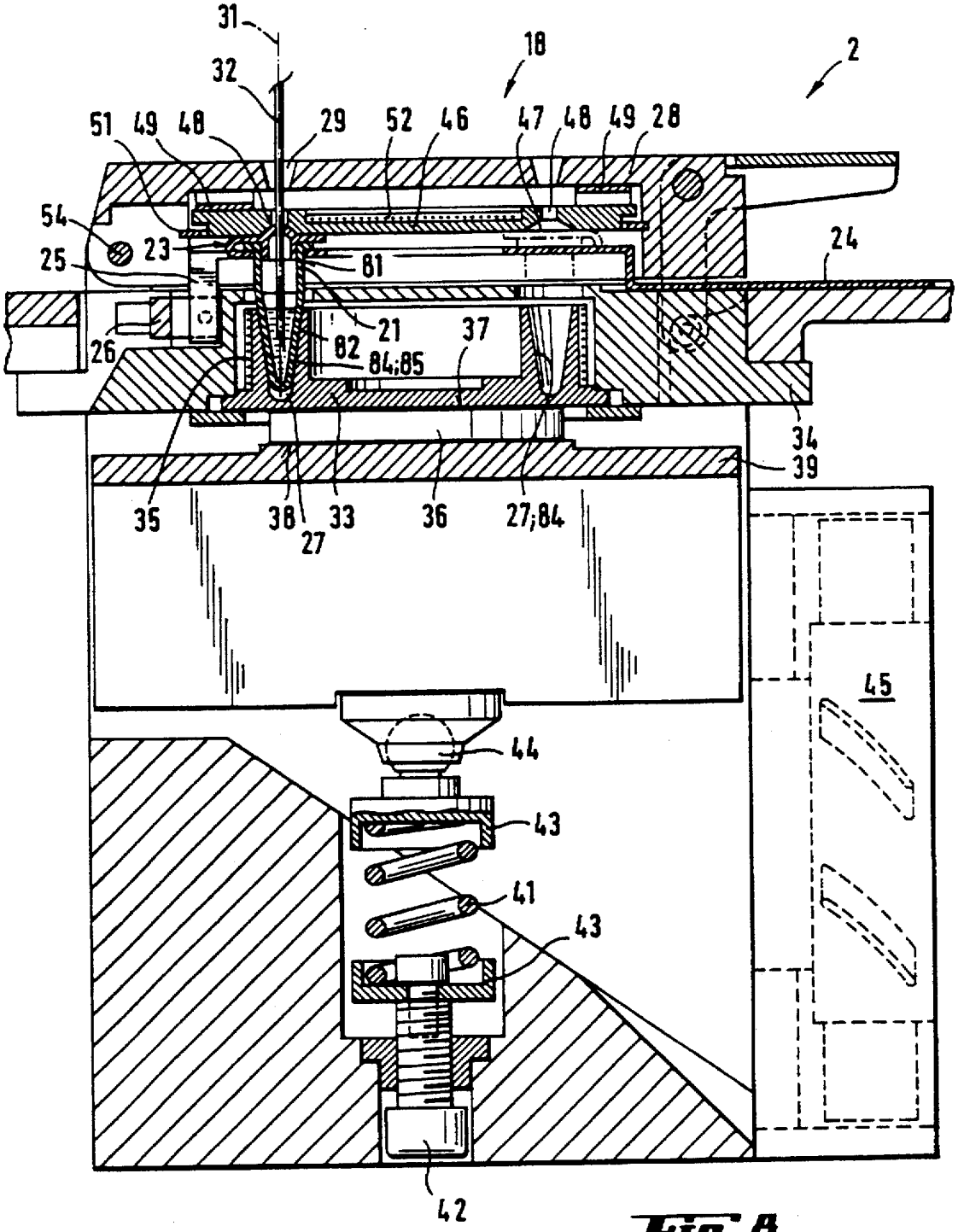
FIG. 8 is a section through line VIII—VIII in FIG. 7, the thermal cycler 18 being closed.

The thermal cycler 18 has a hinged cover 28 formed with an opening 29 for each recess 27 in the unit heater 33, through which a pipetting needle can pierce the closure 87 of the container 21 inserted in the recess. As shown in FIG. 8, when the hinged cover 28 is closed, each opening 29 is in line with the longitudinal axis 31 of the corresponding reaction container 21.

The openings 29 in the hinged cover 28 give access to the contents of each reaction container when the cover 28 is closed. The needle 32 of a pipetting device (not shown in FIG. 8) is inserted through one of the openings 29, the lid 87 of the reaction container 21 is pierced by the needle 32, and a defined volume of the liquid in the reaction container is withdrawn by suction.

Heat Transfer Between the Unit Heater and the Reaction Container

As shown in FIG. 8, the recesses 27 in the unit heater 33 are adapted to the conical region of the reaction containers 21, so that the peripheral wall of the reaction container 21 reliably abuts the inner wall of the recess 27, for improved heat transfer. In order to increase the thermal reaction rate, precision and homogeneity, the unit heater 33 is substantially heat-insulated and held in a casing 34 and has a minimum mass and good thermal conductivity.

Heating Element in the Hinged Cover of the Thermal Cycler

The cover 28 preferably contains a heating element (for example, an electric resistance heater 52) for heating the closed reaction containers disposed in the unit heater 33.

In a first embodiment of the thermal cycler, the electric resistance heater 52 is used in combination with a Peltier element 36 (described hereinafter) in order to obtain a desired temperature profile (variation in temperature during a given time interval) in the unit heater 33. In this embodiment the Peltier element, depending on the required temperature, is used as a cooling or heating element within a temperature profile.

The electric resistance heater 52 cooperates with the Peltier element 36 to obtain the required rapid changes of temperature of the unit heater 33 and the required precision and homogeneity of the temperature distribution. The heater 52 also prevents any condensate forming in the lid region of the reaction container 22.

Device for Closing and Pressing the Hinged Cover of the Thermal Cycler

The cover 28 preferably contains a closing and pressure device for holding the closed reaction containers 21 disposed in the unit heater 32. To this end the cover 28 has a resiliently held pressure plate 46 which presses each container 21 with a defined force into the recesses 27 in the unit heater 33. Recesses 47 for holding the cap-shaped lids 87 of the reaction containers 21 and piercing openings 48 for the pipetting needles 32 are disposed coaxially with the reaction containers 21 in the pressure plate 46. The spring element can be a corrugated washer 49. A safety ring 51 prevents the pressure plate 46 falling out when the cover 28 is opened.

The aforementioned resistance heater 52 is preferably contained in the resilient pressure plate 46.

Peltier Cooling or Heating Element

As shown in FIG. 8, a thermal cycler 18 according to the invention preferably contains at least one Peltier element 36 as a part of the means in the thermal cycler 18 for cyclic alteration of the temperature of the unit heater 33. One heat transfer surface 37 of the Peltier element 36 is in contact over a large area with the unit heater 33 and the other heat transfer surface 38 thereof is in contact over a large area with a cooling member 39 for heat dissipation. The cooling member 39 is preferably of aluminum or copper. A switchable fan 45 is provided for heat dissipation.

The Peltier element 36 shown diagrammatically in FIG. 8 is preferably an arrangement of such elements.

In the previously-mentioned first embodiment of the thermal cycler, the Peltier element 36 is used as a cooling or heating element. This manner of operating the Peltier element 36, and cooperation thereof with the electric resistance heater 52, enables the unit heater to reach the required temperature within a temperature profile.

In order to prolong the life of the Peltier element 36, it is preferably protected from thermodynamic mechanical tension peaks by being pressed against the unit heater 33 by a central spring-biased securing means. To this end the Peltier element is resiliently clamped between the cooling member 39 and the heat transfer surfaces of the unit heater 33. For example a pressure spring 41 presses the contact surface of the cooling member 39 against the Peltier element 36. The spring tension can be adjusted via a screw 42, a spring washer 43 and a ball and socket joint 44, which further increases the degrees of freedom of the cooling member 39.

Additional Heating Element around the Unit Heater

In a second embodiment, the thermal cycler preferably additionally contains an electric resistance heater 35, disposed on the cylindrical outer wall of the unit heater 33. When this additional heating element is used in the thermal cycler, the Peltier element 36 is used only for cooling. This has the advantage of relieving the Peltier element from mechanical thermal stress and thus helps to prolong the life of the Peltier element in the thermal cycler.

Lifting-out Device

As a result of the temperature changes and the action of spring 49, the conical regions of the reaction containers 21 adhere to the wails of the recesses 27 in the unit heater 33. The resulting non-positive connection makes it difficult to remove the reaction containers 21 from the thermal cycler 2. For this reason, in the embodiment in FIGS. 9 to 11, a lifting-out device 53 is provided to considerably facilitate removal of the reaction-container ring 23 out of the thermal block 33.

Figure 10:
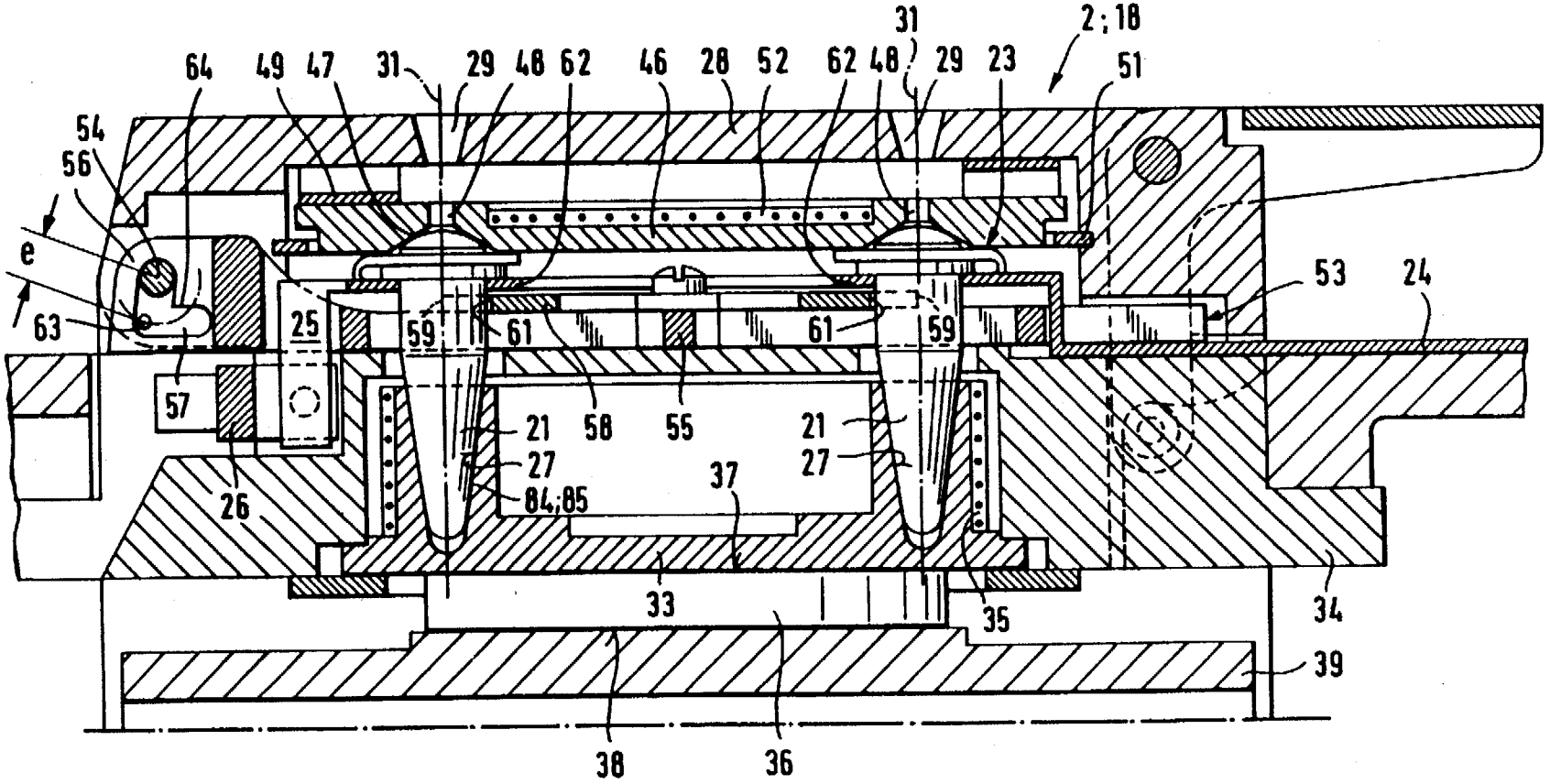
FIG. 10 is a section on a larger scale than FIG. 8, through the thermal cycler in the closed state.
Figure 11:
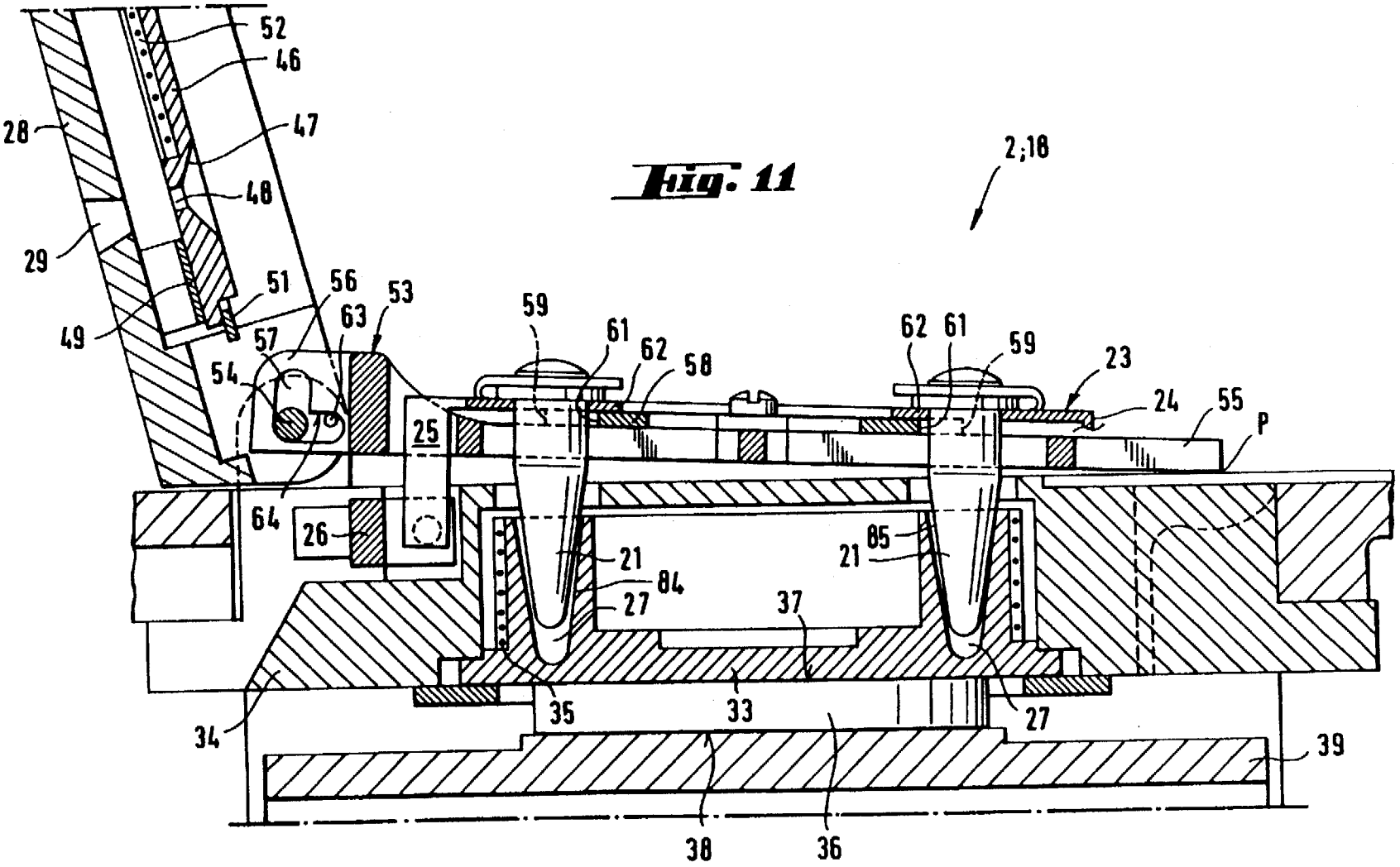
FIG. 11 is a cross-section through the thermal cycler in FIG. 9, in the opened state.

As shown in FIGS. 9 to 11, the lifting-out device 53 contains a rocker 55 serving as an ejection lever. One end of the rocker 55 is connected to a hinge of the cover 28. The other end of the rocker 55 is free. The lifting-out device 53 also contains an ejection disc 58, which is concentric with the axis of symmetry of the unit heater 33 on which the rocker 55 is disposed. On its periphery, the ejection disc 58 has an arrangement of recesses 61 for removing the reaction-container ring 23 from the recesses 27 in the unit heater 33.

As shown in FIG. 9, the rocker 55 is guided on the pivot 54 of the hinged cover 28. On the pivot side the rocker 55 has two lugs 56 with recesses 57 in which the pivot 54 engages. The ejection disc is screwed to the rocker 55. On its peripheral edge 59, the disc 58 has semicircular recesses 61 which are exactly aligned with the projection of the recesses 27 in the unit heater 33 or the cylindrical regions of the reaction containers 21 inserted in the recesses 27 (FIG. 11). The peripheral edge 59 of the disc 58 thus extends under the inner flange-like region 62 of the reaction container ring 23 or the flanges on the containers 21. FIGS. 10 and 11 show the shape and function of the recess 57 in the lugs 56 of rocker 55 in conjunction with the pivot 54 of the cover 28 and a control pin 63 disposed at a distance e on the cover 28 and likewise engaging in the recess 57. When the cover 28 is closed, the lifting-out device 53 provides a thermal screen from the exterior. When the cover 28 is opened beyond a certain angle, the pin 63 comes into contact with a control surface 64 on the recess 57 and pivots the rocker 55 around the point P, thus lifting the sample-containers 21. As a result of the tilting of the rocker 55 around the point P or the increasingly sloping position of the disc 58, the breaking-loose forces associated with the individual reaction containers 21 are offset in time, so that the containers 21 are progressively loosened from their recesses 27. The force applied and the stress on the material is thus kept at a low level and operation is more comfortable.

Automatic Control of the Thermal Cycler

FIG. 12 is a diagram of an automatic control system of a thermal cycler 18 according to the invention, via master-slave processors 72 and 73.

The temperature of the pressure plate 46 of the cover 28, and of the unit heater 33 and the environment is detected by sensors 65, 66, 67 and supplied via a temperature interface 68 to the slave processor 73. The set temperatures, set times, number of temperature cycles and speed of the heating and cooling processes are input into the master processor 72 (the interface to the user).

Predetermined stored temperature/time profiles can be selected and run. Input is via a keyboard 16 or another interface. These data are supplied to the slave processor 73, which via controllers 69 actuates a power output stage 71 which in turn controls the supply of energy to the heating elements 55, 52 and the Peltier element 36. Feedback (actual values) are supplied via the slave processor 73 to the master processor 72, where they are processed or displayed to the user. In this manner the user is informed about the instantaneous temperature of the samples, the temperatures already reached, giving the times required to reach such a temperature, and the temperatures still to be reached, giving times.

The operating state of the system is permanently monitored and recorded. Faults which cannot be eliminated by the system, result in automatic switching-off or a fault alarm.

The temperature of the sample is computed from the temperature of the unit heater 33. To this end the transfer function from the sample chamber to the sample in the reaction container 21 is determined. This function is substantially a low-pass filter with idle time.

Suitable control algorithms (scanned systems) are used to calculate the respective controller output necessary for adjusting the temperature of the sample to the preset temperature. These calculations are made by a signal processor. The calculated controller output is supplied in the form of a pulse width to the power output stage 71. The power output stage 71 is e.g. a power FET with a suitable protective and anti-interference circuit.

The previously-described automatic control system is for using the thermal cycler for heating and cooling samples in accordance with given temperature profiles, in a ring of reaction containers inserted into the thermal cycler. The temperature profiles are defined by plateau temperatures of defined duration, and the gradient defining the time at which a plateau temperature must be reached. This means that all samples in the thermal cycler must be at the same temperature at the same time.

Figure 13:
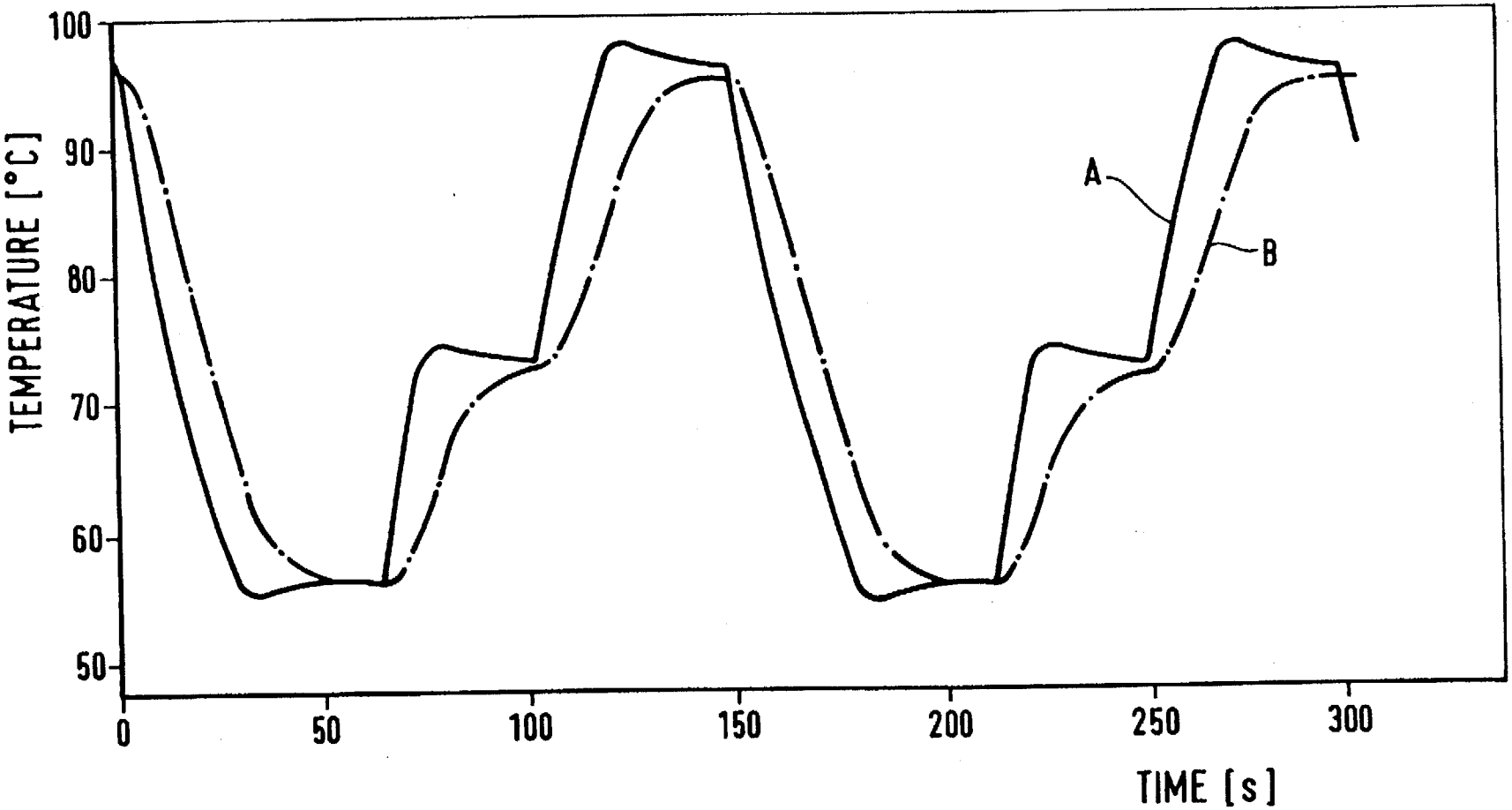
FIG. 13 is a temperature-time graph showing the temperature curve stored in the master processor and the resulting temperatures of the unit heater and the sample.

FIG. 13, by way of example, shows temperature curves in a cyclic process. Curve A shows the temperature at the unit heater 33, and curve B shows the temperature in the reaction container 21. The thermal cycler can be used for setting temperatures between about 40° and about 98° C. Typically the lower temperatures are between about 50° and 60° C. and the upper temperatures between about 90° and about 96° C. When the average temperature is used, it is around 72° C. The rate of heating and cooling by the thermal cycler is about 1° C. per second. A typical cycle lasts about 120 seconds. When the corresponding temperatures have to be held for longer than about 10 seconds, the cycle is prolonged accordingly.

Analytical Device with a Thermal Cycler

FIG. 14 shows an analytical device 1, designed, for example, for performance of immunoassays.

To increase the volume of substances present in the samples under analysis, to above the detection limit in the subsequent process of analysis, the analytical device incorporates a thermal cycler part 2 containing previously-described thermal cyclers 18 and 19 according to the invention, for working a DNA amplification process using the polymerase chain reaction.

To increase the productivity of the analytical device (i.e. to process a maximum number of samples per unit time), the number of prepared samples has to be adapted to the subsequent process times, to avoid any idle times. This is achieved, for example, by two independently operating thermal cyclers 18 and 19, each capable of holding twelve reaction containers 21, and two standby stations 22, likewise each capable of holding twelve reaction containers 21 taken from one of the thermal cyclers 18, 19 at the end of the process therein.

The analytical device 1 also contains all other equipment for the aforementioned immunoassays, e.g. two racks 3, 4 holding reagents on a vibrating table 5, a rack 6 holding other reagents, three racks 7 containing throwaway reaction containers 8, a temperature-controlled incubator 9 into which the reaction containers 8 are inserted, a washing device 11 and a photometer device 12 for determining the result of the test.

Test Head of the Analytical Device

The samples, reagents, and reaction-holders are transferred by a head movable in an x-y coordinate system and containing a pipetting device 14 and a reaction-container gripper 15, both movable in the z direction.

After DNA amplification in the reaction containers 21 in the thermal cyclers 18 and 19, the pipetting device 14 takes volumes of sample from the reaction containers 21 and delivers them to reaction containers 8 disposed in the racks 7. The volumes of samples delivered to the reaction containers 8 are investigated in immunoassays made by the analytical device.

Control Unit of the Analytical Device

All required operations are controlled and coordinated by a central control unit (not shown) belonging to the analytical device. A control panel 16 or keyboard for inputting process parameters, and a display for displaying states of the process, are diagrammatically indicated. Data regarding the samples, recorded on the reaction containers e.g. in a bar code, can be read into a store via a manually guided wand or scanner 17. Interfaces for a printer etc. (not shown) are provided.

The subject invention has been described in terms of its preferred embodiments. However, upon reading the present specification, various alternative embodiments will become obvious to those skilled in the art. For example, tube thicknesses; angles, materials, etc. are readily variable. These variations are to be considered within the scope and spirit of the present invention which is only to be limited by the claims which follow and their equivalents.

What is claimed is:

1. An arrangement of reaction containers for bringing about temperature cycles in a liquid mixture contained within the reaction containers, which comprises:

(a) a plurality of reaction containers each having substantially the same shape and dimensions, each reaction container having (i) a first conical wall region, and (ii) a second cylindrical wall region adjacent the first conical wall region, and open at one end to form the opening of the reaction container, the thickness of the first wall region being less than the thickness of the second wall region; and (b) a plurality of closures, each closure being configured and dimensioned to fit within the opening of a reaction container and close the reaction container in a gas-tight manner, each closure being configured and dimensioned to be piercable by a pipetting needle.

2. The arrangement according to claim 1, wherein the plurality of reaction containers are made in one piece from a plastic, and adjacent reaction containers are joined by a flexible web.

3. The arrangement according to claim 2, wherein the plurality of closures are made in one piece from the same plastic as the plurality of reaction containers, adjacent closures in the arrangement being joined by at least one flexible web.

4. The arrangement according to claim 2, wherein the plurality of reaction containers are arranged as a continuous loop.

5. The arrangement according to claim 3, wherein the plurality of closures are arranged as a continuous loop.

6. The arrangement according to claim 1, wherein the plurality of reaction containers are made in one piece from a plastic and form at least a segment of a ring, with adjacent reaction containers being joined by a flexible web to form an assembly of reaction containers.

7. The arrangement of reaction containers according to claim 6, wherein the plurality of closures forms at least a segment of a ring and is made in one piece from the same plastic as the reaction containers, adjacent closures in the arrangement being joined by at least one flexible web to form an assembly of closures with each closure being adapted to close one reaction container in gas-tight manner when placed in the opening thereof, the arrangement being assembled by juxtaposing the assembly of reaction containers with the assembly of closures.

8. The arrangement according to claim 6, wherein the arrangement of the plurality of reaction containers forms a complete ring.

9. The arrangement according to claim 7, wherein the plurality of closures forms a complete ring.

10. An arrangement of reaction containers for bringing about temperature cycles in a liquid mixture contained within the reaction containers, which comprises:

(a) a plurality of reaction chambers each having substantially the same shape and dimensions, being made in one piece from a plastic with each reaction container being joined to at least one other reaction container by a flexible web, each reaction container having (i) a first conical wall region, and (ii) a second cylindrical wall region adjacent the first conical wall region and open at one end to form the opening of the reaction container, the thickness of the first wall region being less than the thickness of the second wall region; and (b) a plurality of closures made in one piece from the same plastic as the reaction containers, each closure being joined to at least one other closure by at least one flexible web, each closure being piercable by a pipetting needle, and configured and dimensioned to fit within the opening of a reaction container and close the reaction container in gas-tight manner.

11. The arrangement according to claim 3, wherein that the arrangement has an extension for positioning or detecting the arrangement.

12. The arrangement according to claim 7, wherein that the arrangement has an extension for positioning or detecting the arrangement.

13. The arrangement according to claim 10, wherein that the arrangement has an extension for positioning or detecting the arrangement.

14. In a thermal cycler for bringing about temperature cycles in a liquid mixture contained within an arrangement of reaction containers, the improvement comprising (a) the thermal cycler having a pipetting needle and (b) the reaction containers each having (1) a first conical wall region, (2) a second cylindrical wall region adjacent the first conical wall region, the thickness of the first wall region being less than the thickness of the second wall region; and (3) a closure configured and dimensioned to seal the reaction container in a gas-tight manner, each closure being configured and dimensioned to be piercable by the pipetting needle.

* * * * *